United States Patent [19]

Brownell

[11] 4,321,291

[45] Mar. 23, 1982

[54] DECORATIVE BUTTERFLY AND METHOD OF CONSTRUCTION

[76] Inventor: David A. Brownell, 332 E. Maplehurst, Ferndale, Mich. 48220

[21] Appl. No.: 150,797

[22] Filed: May 19, 1980

[51] Int. Cl.[3] ..... A63H 33/16

[52] U.S. Cl. ..... 428/16; 46/1 L; 428/181

[58] Field of Search ..... 46/124, 1 L; 428/16, 428/181; 40/124.1, 539; 156/61, 204; 493/955, 959, 405; 416/71, 72, 73

[56] References Cited

U.S. PATENT DOCUMENTS

| | | | |
|---|---|---|---|
| 278,410 | 5/1883 | De Quillfeldt | 416/73 |
| 563,489 | 7/1896 | Johnson | 428/16 X |
| 2,164,966 | 7/1939 | Tutein | 428/7 X |
| 2,325,710 | 8/1943 | Schweitzer | 40/324 X |
| 2,725,654 | 12/1955 | Kosikar | 428/16 |
| 2,793,454 | 5/1957 | Shoemaker | 428/16 |

*Primary Examiner*—Henry F. Epstein
*Attorney, Agent, or Firm*—McGlynn and Milton

[57] ABSTRACT

A decorative butterfly and the method and assembly of constructing the same. The decorative butterfly includes a central portion with a center line passing therethrough and a wing disposed on each side of the center line and extending from the central portion. Each of the wings has a plurality of pleats extending radially from the central portion.

The method of forming the decorative butterfly includes the steps of forming a plurality of parallel and alternately oppositely folded up and down pleats in a sheet of material. The pleats are secured together at a central portion on the center line which passes perpendicularly through the pleats while allowing the pleats to fan out from the center portion on either side of the center line.

10 Claims, 6 Drawing Figures

DECORATIVE BUTTERFLY AND METHOD OF CONSTRUCTION

BACKGROUND OF THE INVENTION (1) Field of the Invention

The subject invention relates to a decorative butterfly to be used as an ornament on clothing, on packages, or on any other suitable surface to which the butterfly can be secured.

(2) Description of the Prior Art

Prior art decorative butterflies have been constructed in accordance with complicated and costly methods. Furthermore, the intent has been to create an item which closely resembles an insect rather than giving the abstract appearance of the shape, form and delicateness of an actual butterfly. Therefore, prior art concepts have been directed toward specific details for an insect-like appearance rather than the more aesthetically pleasing qualities of a butterfly.

SUMMARY OF THE INVENTION

The instant invention provides a decorative butterfly including a central portion with a center line passing therethrough and a wing disposed on each side of the center line and extending from the central portion. Each of the wings have a plurality of pleats extending radially from the central portion.

The instant invention further provides a method of forming the decorative butterfly comprising the steps of forming a plurality of parallel and alternately oppositely folded up and down pleats in a sheet of material and securing the pleats together at a central portion on the center line which passes perpendicularly through the pleats while allowing the pleats to fan out from the central portion on either side of the center line.

PRIOR ART STATEMENT

An example of a prior art artificial butterfly is the U.S. Pat. No. 563,489 to Johnson issued July 7, 1896. The Johnson patent teaches an artificial butterfly having gathered wings and a tissue-paper body held together by a plurality of wires. The gathers or folds of the wings are random and are not folded so as to contribute significantly to the final shape of the wings. Furthermore, the method of construction is restricted to the use of tissue paper for the wings and is quite complicated; therefore, the Johnson butterfly cannot be easily adapted for mass production.

The U.S. Pat. No. 2,725,654 to Kosikar, issued Dec. 6, 1955, teaches an artificial insect having a body formed from flexible wires stuffed with material to give the appearance of a butterfly body. Again, the concept is directed toward the intricate detail of the insect body and not toward the simple design of the instant invention. Also, the Kosikar insect is quite complex in design and requires many parts. Therefore, the instant invention is much more delicate and abstract in design while being much simpler in construction. Furthermore, the instant invention is less expensive to manufacture.

BRIEF DESCRIPTION OF THE DRAWINGS

Other advantages of the instant invention will be readily appreciated as the same becomes better understood by reference to the following detailed description when considered in connection with the accompanying drawings wherein.

DESCRIPTION OF PREFERRED EMBODIMENT

Figure 4:
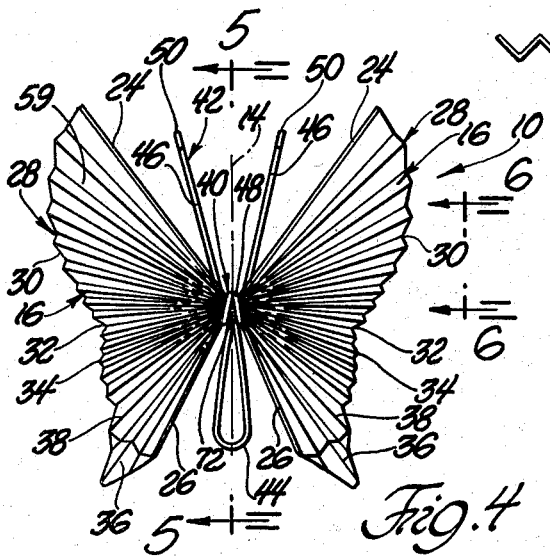
FIG. 4 is a plan view of the instant invention.
Figure 5:
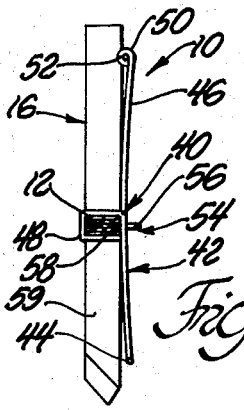
FIG. 5 is a cross-sectional view of the instant invention taken substantially along lines 5—5 of FIG. 4.
Figure 6:
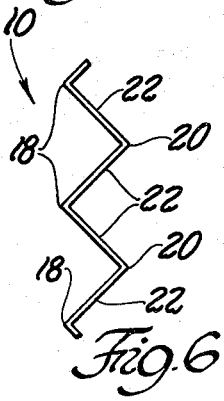
FIG. 6 is a fragmentary side view of the instant invention taken substantially along line 6—6 of FIG. 4.

A decorative butterfly constructed in accordance with the instant invention is generally shown at 10 in FIGS. 4, 5 and 6.

The butterfly 10 includes a central portion 12 with a center line 14 passing therethrough. A wing generally indicated at 16 is disposed on either side of the center line 14 and extends from the central portion 12. In other words, each wing 16 falls on one side of the center line 14, the central portion 12 being situated on the center line.

Each of the wings 16 has a plurality of pleats extending radially from the central portion 12. As shown in FIG. 6, the pleats have up 18 and down 20 bends. The up 18 and down 20 bends of each pleat are spaced from one another the same distance as the up 18 and down 20 bends for the remaining pleats. A pleat is defined as including any two adjacent intermediate portions 22 with an upper 18 or lower 20 bend therebetween. All of the adjacent pleats are of an equal size. In other words, the width of the intermediate portion 22 between the up 18 and down 20 bends is equal to the width of any other intermediate portion 22 between any other up 18 and down 20 bend. The result is the specific radial extension of the pleats from the central portion 12. This construction allows the wings, if made from a plastic, to be easily molded. Also, these pleats contribute to the simple and delicate, yet striking appearance of the subject butterfly 10.

As shown in FIG. 4, each of the wings 16 includes a top end pleat 24 and a bottom end pleat 26. The top end pleats 24 of the wings 16 diverge from one another in extending from the central portion 12. The bottom end pleats 26 of the wings 16 also diverge from one another in extending from the central portion 12. In other words, a V-shape is created by the top and bottom end pleats 24 and 26 as they diverge from the central portion 12.

The radially outward ends of the pleats generally indicated at 28 define an upper arcuate extremity 30 of each wing 16 extending from the top end pleat 24 thereof to a central narrowed waist 32. The radially outward ends 28 of the pleats also define a lower arcuate extremity 34 of each wing 16 extending from the waist 32 toward the bottom end pleat 26 thereof. The preferred embodiment of the instant invention includes an extended pleat 36 which is radially longer than the next adjacent pleat 38 in an upward direction. The two adjacent intermediate portions 22 of the extended pleat 36 may be glued together. An alternative embodiment of the instant invention can include a lower arcuate extremity of each wing 16 extending from the waist 32 to the bottom pleat thereof. In other words, the lower arcuate extremity can extend completely to the bottom pleat 26 and not include the radially longer bottom extended pleat 36 without detracting from the instant invention.

The subject butterfly 10 includes securing means generally indicated at 40 for holding the pleats together at the central portion 12. The securing means 40 includes a U-shaped wire generally indicated at 42 having an arcuate portion 44 and two legs 46 extending therefrom. The legs 46 include a portion 48 that is spaced from the ends 50 of the legs 46. As shown in FIGS. 4 and 5, the portion 48 is compressed together and looped about the central portion 12 whereby the arcuate portion 44 of the U-shaped wire 42 appears as an insect abdomen and the legs 46 of the U-shaped wire 42 appear as insect antennae. In other words, the insect body is simply constructed by looping a U-shaped wire 42 about the central portion 12 of the wings 16. This simple process lends itself well to mass production while giving a delicate and aesthetically pleasing appearance to the decorative butterfly 10. The ends 50 of the legs 46 may include a loop 52 for further enhancing the appearance of the legs 46. It is also possible to construct the instant invention by merely looping a single wire about the central portion 12. This alternative embodiment still provides the appearance of a butterfly via the wings 16 and is simpler to construct and mass produce.

As shown in FIG. 5, the subject butterfly 10 may include attachment means generally indicated at 54 for attaching the decorative butterfly 10 to a surface. The attachment means 54 includes at least one pronged portion 56 and a head portion 58 being substantially perpendicular to the pronged portion 56. The head portion 58 is disposed within the loop portion 48 of the wire 42 whereby the wire 42 secures the attachment means 54 to the central portion 12. In other words, a pin having a straight pronged portion and a head perpendicular to the straight pronged portion can be pivotally secured within the looped portion 48 of the wire 42 for attaching the decorative butterfly 10 to a garment or other material or for inserting the decorative butterfly into one's hair. Other means for attaching the decorative butterfly to a surface can also be secured to the butterfly 10. The preferred embodiment of the instant invention provides a decorative butterfly of simple construction being made from only three separate parts. The wings 16 can be made from a pliant piece of paper or can be molded from a piece of plastic. The securing means is made from a single wire as is the attachment means. Therefore, the decorative butterfly 10 requires few parts.

Figure 3:
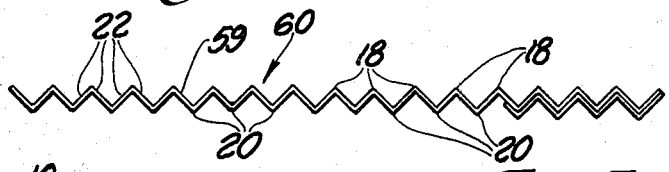
FIG. 3 is a view of the longitudinal edge of the sheet of material folded along the fold lines shown in FIG. 2 to define pleats.

In constructing the subject decorative butterfly, a plurality of parallel and alternately oppositely folded up and down pleats are formed in a sheet of material 59 as generally shown at 60 in FIG. 3. The pleats are secured together at a central portion 12 on the center line 14 which passes perpendicularly through the pleats while allowing the pleats to fan out from the central portion 12 on either side of the center line 14 as shown in FIG. 4.

A pleat is defined as including two adjacent intermediate portions 22 and an upper 18 or lower 20 bend therebetween, as previously described.

Referring again to FIG. 3, the adjacent parallel pleats are of equal sizes. In other words, each intermediate portion 22 has an equal width between any up 18 and down 20 bend.

Figure 2:
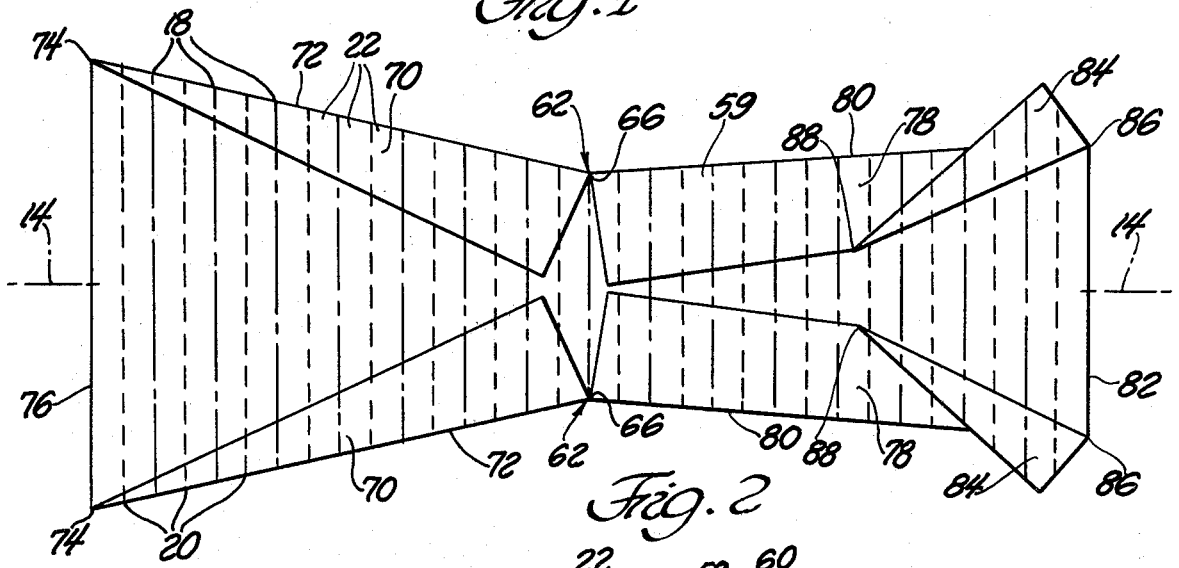
FIG. 2 is a plan view of the sheet of material folded about the fold lines shown in FIG. 1 and including additional fold lines for pleats.

As shown in FIG. 2, a narrow waist 62 is formed in an elongated sheet of material 59 transverse to the center line 14 prior to forming the pleats. The waist 62 can be made by cutting the sheet of material 59 in accordance with the shape shown in FIG. 2 or the material can be folded in accordance with the instant invention as described below.

Figure 1:
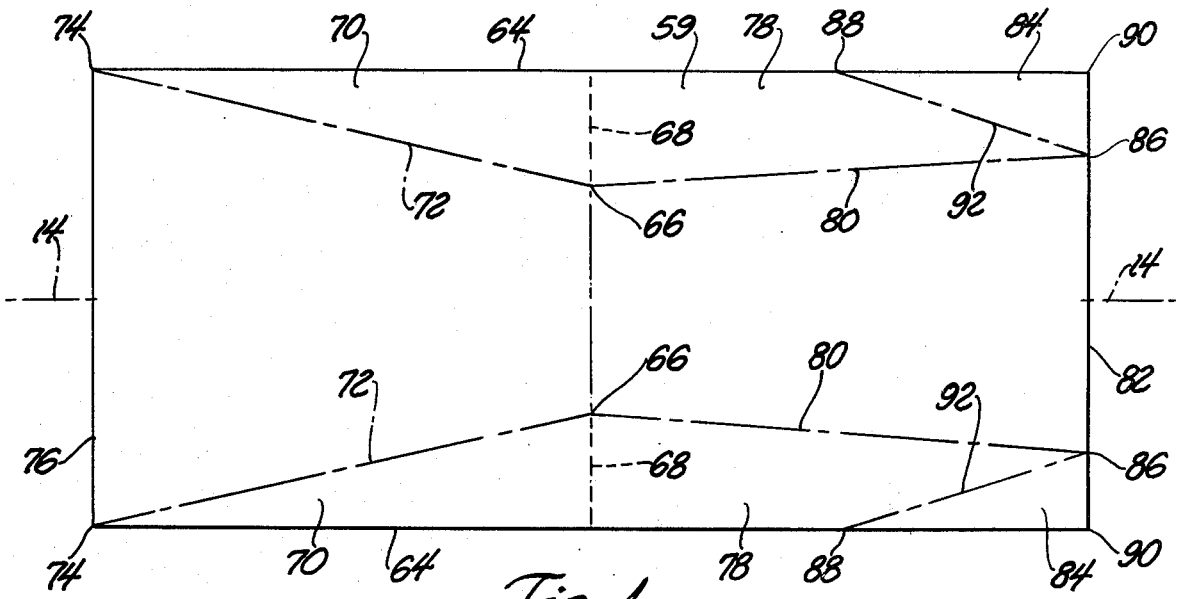
FIG. 1 is a plan view of the unfolded sheet of material including the appropriate fold lines.

Referring to FIG. 1, the sheet 59 is cut from each longitudinal edge 64 inwardly to two spaced waist end points 66 with the waist end points 66 disposed symmetrically of the center line 14. As shown in FIG. 1, each of the waist end points 66 is disposed one quarter of the width of the sheet 59 inwardly from the associated longitudinal edge 64, the sheet having a length-to-width ratio of 9:4.

A pair of first flaps 70 are folded along symmetrical lines 72 extending from the waist end points 66 to the forward corners 74 of the forward edge 76. A second pair of flaps 78 are folded along symmetrical lines 80 extending from the waist end points 66 to the rearward edge 82. As shown in FIG. 2, the folding of the flaps in accordance with the method described above results in the waisted portion 62 being disposed between the forward 76 and rearward 82 edges of the sheet 59. The waisted portion 62 is disposed halfway between the two edges 76 and 82.

As shown in FIG. 1, a third pair of flaps 84 can be folded symmetrically about the center line 14 extending from the intersection 86 of each of the second pair of flaps 78 with the rearward edge 82 of the sheet 59 to a point 88 along the longitudinal edge 64 of the sheet 59. The third flaps 84 can be secured in place with an appropriate glue or other adhesive compound.

The second flaps 78 are folded so that each second flap 78 intersects with the rearward edge 82 of the sheet 59 one-sixth of the width of the sheet 59 from the adjacent original corners 90 of the sheet 59 about line 80. The third pair of flaps 84 are folded along the lines 92 so that each line 92 extends to the point 88 being one-quarter the length of the longitudinal edge 64 of the sheet 59 from the corners 90. The result is that the forward edge 76 of the sheet 59 is wider than the rearward edge 82 with the waisted portion 62 being disposed halfway therebetween. The width of the waist 62 is one-half the width of the forward edge 76 and the width of the rearward edge 82 is two-thirds the width of the forward edge 76.

As shown in FIG. 2, the adjacent parallel pleats, being equal distances apart or equal sizes, are formed by dividing the sheet lengthwise into a plurality of equal portions to correspond with the up and down bends, 18 and 20 respectively. In the FIG. 2 the sheet 59 is divided by the hashed lines into thirty-two equal divisions. This sheet can be divided into more or less hashed lines to create more or less bends in the sheet 59.

As shown in FIG. 3, the material 59 is folded alternately up and down so that each adjacent up 18 and down 20 bend are equal distances apart. As shown in FIG. 5, a wire 42 is looped about the central portion 12 of the folded material 59 so as to hold the folds together. As previously stated, the two adjacent intermediate portions 22 of the extended pleat 36 may be glued together.

As shown in FIGS. 4 and 5, the legs 46 of a U-shaped wire generally indicated at 42 are compressed together at a portion 48 spaced from the ends 50 of the U-shaped wire 42. The compressed portion 48 is looped about the central portion 12 of the pleated sheet 59 so that the extending legs 46 of the U-shaped wire 42 give the appearance of two butterfly antennae and the closed portion 44 of the U-shaped wire 42 gives the appearance of a butterfly abdomen. Alternatively, a single wire can be used to hold the pleats together by wrapping the wire around the central portion 12 of the folded material 59. Also, if the wings are molded from plastic to the final shape shown in FIG. 4, there is no need for the wire to be used except to provide the appearance of the insect abdomen and antennae.

The instant invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are not to be in any way limiting, the invention may be practiced otherwise than as specifically described.

The embodiments of the invention in which an exclusive property or privilege is claimed are defined as follows:

1. A decorative butterfly (10) comprising; a central portion (12) with a center line (14) passing therethrough, a wing (16) disposed on each side of said center line (14) and extending from said central portion (12), each of said wings (16) having a plurality of pleats extending radially from said central portion (12).

2. A butterfly as set forth in claim 1 wherein said pleats have up (18) and down (20) bends, said up (18) and down (20) bends of each pleat being spaced from one another equal distances.

3. A butterfly as set forth in claim 2 wherein each of said wings (16) includes a top end pleat (24) and a bottom end pleat (26), said top end pleats (24) of said wings (16) diverging from one another in extending from said central portion (12), said bottom end pleats (26) of said wings (16) diverging from one another in extending from said central portion (12).

4. A butterfly as set forth in claim 3 wherein the radially outward ends (23) of said pleats define an upper arcuate extremity (30) of each wing (16) extending from said top end pleat (24) thereof to a central narrowed waist (32) and a lower arcuate extremity (34) of each wing (16) extending from said waist (32) toward said bottom end pleat (26) thereof.

5. A butterfly as set forth in claim 4 including an extended pleat (36) adjacent each of said bottom end pleats (2b) which is radially longer than the next adjacent pleat (38) in an upward direction.

6. A butterfly as set forth in claim 4 including securing means (40) for holding said pleats together at said central portion (12).

7. A butterfly as set forth in claim 6 wherein said securing means (40) includes a looped wire (42) wrapped about said central portion (12).

8. A butterfly as set forth in claim 7 wherein said wire (42) is U-shaped having an arcuate portion (44) and two legs (46) extending therefrom, said legs (46) including a loop portion (48) spaced from the ends (50) of said legs (46) which is compressed together and looped about said central portion (12) whereby said arcuate portion (44) of said U-shaped wire (42) appears as an insect abdomen and said legs (46) of said U-shaped wire (42) appears as insect antennae.

9. A butterfly as set forth in claim 8 including attachment means (54) for attaching said decorative butterfly (10) to a surface, said attachment means (54) including at least one pronged portion (56) and a head portion (58) being substantially perpendicular to said pronged portion (56), said head portion (58) being disposed within said loop portion (48) of said wire (42) whereby said wire (42) secures said attachment means (54) to said central portion (12).

10. A butterfly as set forth in claim 9 wherein said wings (16) are made from a pliant piece of paper.

* * * * *